US008573722B2

(12) United States Patent
Walker et al.

(10) Patent No.: US 8,573,722 B2
(45) Date of Patent: Nov. 5, 2013

(54) INK FLOW REGULATION MECHANISM

(75) Inventors: Casey E. Walker, Boulder, CO (US); Stuart J. Boland, Denver, CO (US); John R. O'Toole, Longmont, CO (US); Larry M. Ernst, Longmont, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 378 days.

(21) Appl. No.: 13/025,406

(22) Filed: Feb. 11, 2011

(65) Prior Publication Data

US 2012/0206515 A1 Aug. 16, 2012

(51) Int. Cl.
*B41J 29/38* (2006.01)
*B41J 29/393* (2006.01)

(52) U.S. Cl.
USPC ..... 347/6; 347/19

(58) Field of Classification Search
CPC ..... B41J 2/17556; B41J 2/17596
USPC ..... 347/6, 7, 19, 84–86
See application file for complete search history.

(56) References Cited

U.S. PATENT DOCUMENTS 6,352,324 B1 3/2002 Pagnon
6,435,638 B1 8/2002 Wilson
6,796,627 B2 9/2004 Kimura
7,455,381 B2 11/2008 Koike
7,472,976 B2 1/2009 Usuda
8,210,629 B2 * 7/2012 Adkins et al. ..... 347/7
2001/0017641 A1 8/2001 Kobayashi
2007/0040859 A1 2/2007 Kimura
2008/0198187 A1 8/2008 Aoki
2008/0238979 A1 10/2008 Umeda
2009/0174735 A1 7/2009 Yamada

OTHER PUBLICATIONS

Arey, D E., "Maintenance System and Sequence for Impulse Ink Jet Printer", IP.com IPCOM000065160D, (Nov. 1, 1985).
Arnold, R W., "Satellite and Faulty Drop Sensor in Velocity Control System of an Ink Jet Printer", IP.com IPCOM000087705D, (Mar. 1, 1977).
Bishop, "Otical Drop Servo Scheme", IP.com IPCOM000051799D, (Mar. 1, 1981).
Buehner, W L., "Two Level Ink Jet Deflection Control System", IP.com, (Mar. 1, 1974).
Hendriks, F. , "Air Supply for Aspirated Ink Jet Printers", IP.com IPCOM000052738D, (Jul. 1, 1981).
Irwin, J W., "Pressure Vacuum Feedback in Ink Jet Printer Copier", IP.com IPCOM000054573D, (Mar. 1, 1980).

* cited by examiner

*Primary Examiner* — An Do
(74) *Attorney, Agent, or Firm* — Blakely, Sokoloff, Taylor & Zafman LLP

(57) ABSTRACT

A method is disclosed. The method includes setting a desired flow rate for ink in an ink jet printer, measuring an actual flow rate of the ink, determining if the measured flow rate is equal to the desired flow rate and adjusting the flow rate if the measured flow rate is not equal to the desired flow rate.

20 Claims, 3 Drawing Sheets

INK FLOW REGULATION MECHANISM

FIELD OF THE INVENTION

This invention relates generally to the field of ink jet printing systems. More particularly, the invention relates to ink flow supply within an ink jet printing system.

BACKGROUND

An ink jet printer is as an example of a printing apparatus that ejects droplets of ink onto a recording medium such as a sheet of paper, for printing an image on the recording medium. The ink jet printer includes a print engine having at least one ink jet head provided with an ink cartridge that accommodates the ink. In operation of the print engine, the ink is supplied from the ink cartridge to ejection nozzles within each ink jet head, so that a printing operation is performed by ejection of the ink droplets from selected ejection nozzles.

However, ink jet printers typically implement an uncompensated pressurized ink cartridge or positive pressure pump to supply ink to an ink reservoir or print head. This supply is typically provided without monitoring pressure or flow rate of the ink, or estimating the demand of ink prior to supply. These systems are demand based (e.g., supply ink after ink has been printed), and as a result, the ink supply system may falter, either due to insufficient ink flow, an oversupply of ink, or suffer from poor system response time.

Therefore, a method to predict ink usage and regulate ink flow accordingly in an ink jet printer is desired.

SUMMARY

In one embodiment, a method is disclosed. The method includes setting a desired flow rate for ink in an ink jet printer, measuring an actual flow rate of the ink, determining if the measured flow rate is equal to the desired flow rate and adjusting the flow rate if the measured flow rate is not equal to the desired flow rate.

In further embodiment, a printer is disclosed. The printer includes a print engine including an ink jet print head having a plurality of ink nozzles; and a cartridge to supply ink to the print head. The printer further includes a control unit that provides feedforward dynamic control to regulate ink flow from the cartridge to the print head.

BRIEF DESCRIPTION OF THE DRAWINGS

Embodiments of the present invention may be understood more fully from the detailed description given below and from the accompanying drawings of various embodiments of the invention. The drawings, however, should not be taken to be limiting, but are for explanation and understanding only.

DETAILED DESCRIPTION

An ink flow regulating mechanism is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
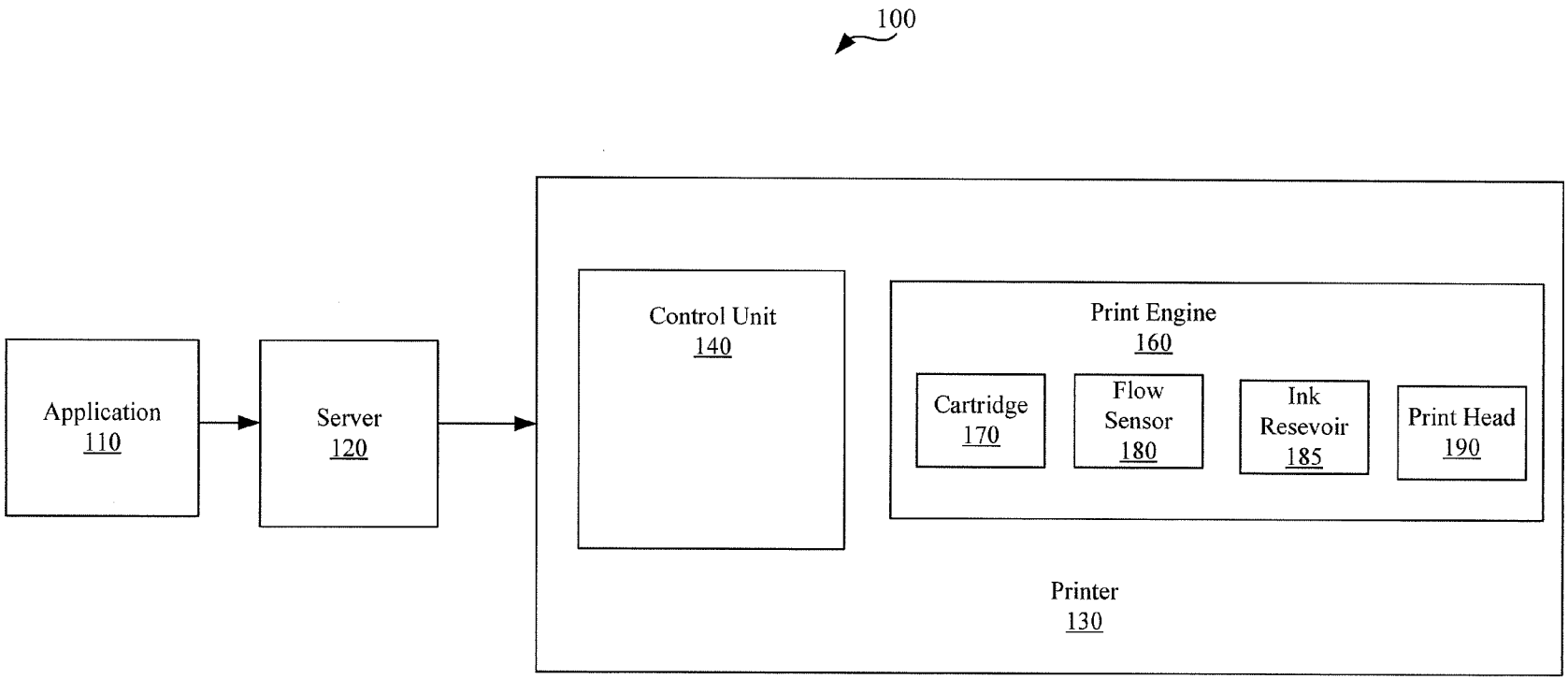
FIG. 1 is a block diagram illustrating one embodiment of a print system.

FIG. 1 illustrates one embodiment of a printing system 100. Printing system 100 includes a print application 110, a server 120 and a printer 130. Print application 110 makes a request for the printing of a document. Print server 120 processes pages of output that mix all of the elements normally found in presentation documents, e.g., text in typographic fonts, electronic forms, graphics, image, lines, boxes, and bar codes.

Print server 120 subsequently communicates with printer 130. Printer 130 includes a control unit 140 and a print engine 160. Control unit 140 receives print jobs into printer 130. Further, control unit 140 processes and renders objects received from print server 120 and provides sheet side maps for printing to print engine 160. Print engine 160 provides an imaging process to mark a printable recording medium (e.g., paper).

In one embodiment, print engine 160 includes a cartridge 170, flow sensor 180, ink reservoir 185 and print heads 190. Cartridge 170 supplies ink to ink reservoir 185, which is then provided to print heads 190. In other embodiments, flow sensor 180 and reservoir 185 may be combined into a single device where flow rate is correlated to the rate of change of ink volume (or equivalent parameter such as height of ink in reservoir 185). According to one embodiment, print heads 190 are fixed, wide-array ink jet print heads including one or more nozzles that are implemented to spray droplets of ink onto a sheet of paper in order to execute a print job. However, print heads 190 may include other types of ink jet print heads, as well as a moving print head design.

In one embodiment, flow sensor 180 measures the flow of ink from cartridge 170 to print heads 190. In such an embodiment, control unit 140 continuously monitors the flow rate of ink measured at flow sensor 180 in order to regulate the ink flow. In a further embodiment, the ink flow is regulated by adjusting cartridge 170 pressure or via a positive pressure pumping device to either increase or decrease pressure based on flow measured at flow sensor 180.

In a further embodiment, control unit 140 analyzes information associated with each print job received in order to estimate an amount of ink that is to be supplied from cartridge 170. Control unit 140 performs the analysis of the ink usage estimate for every individual sheet side prior to transmitting the sheet side print job data to print engine 160. Because the estimate is calculated in advance of the actual ink demand by print head 190, the ink demand information is optimally delayed to minimize ink pressure gradient at reservoir 185 and at printhead 190 achieving an optimal ink flow.

The optimal delay may appear as a combination of a fixed time delay and a variable delay. The variable delay is a function of the print job complexity where each sheet side of the individual print jobs is tracked through the processing path including a buffer. The buffer is used to ensure sheet side data is available for print engine 160 when requested.

The fixed time is the portion of the data processing path where the sheet side data is transmitted to print head 190 and the actual data processing time is predictable consistent with print engine 160 process controls (e.g., data arrives at print head 190 at the exact moment to place each individual drop on the paper at the correct paper location. In one embodiment, drops may be a single volume or different volumes dependent on print engine design.

The ink usage estimate appears effectively as a real time estimate to the ink flow system, thereby reducing overall system response time. In one embodiment, the optimal delay may also incorporate physical ink supply system response delays based on known electrical, mechanical and fluid properties of the system. Thus a variable ink flow is provided to match actual ink demand.

Figure 2:
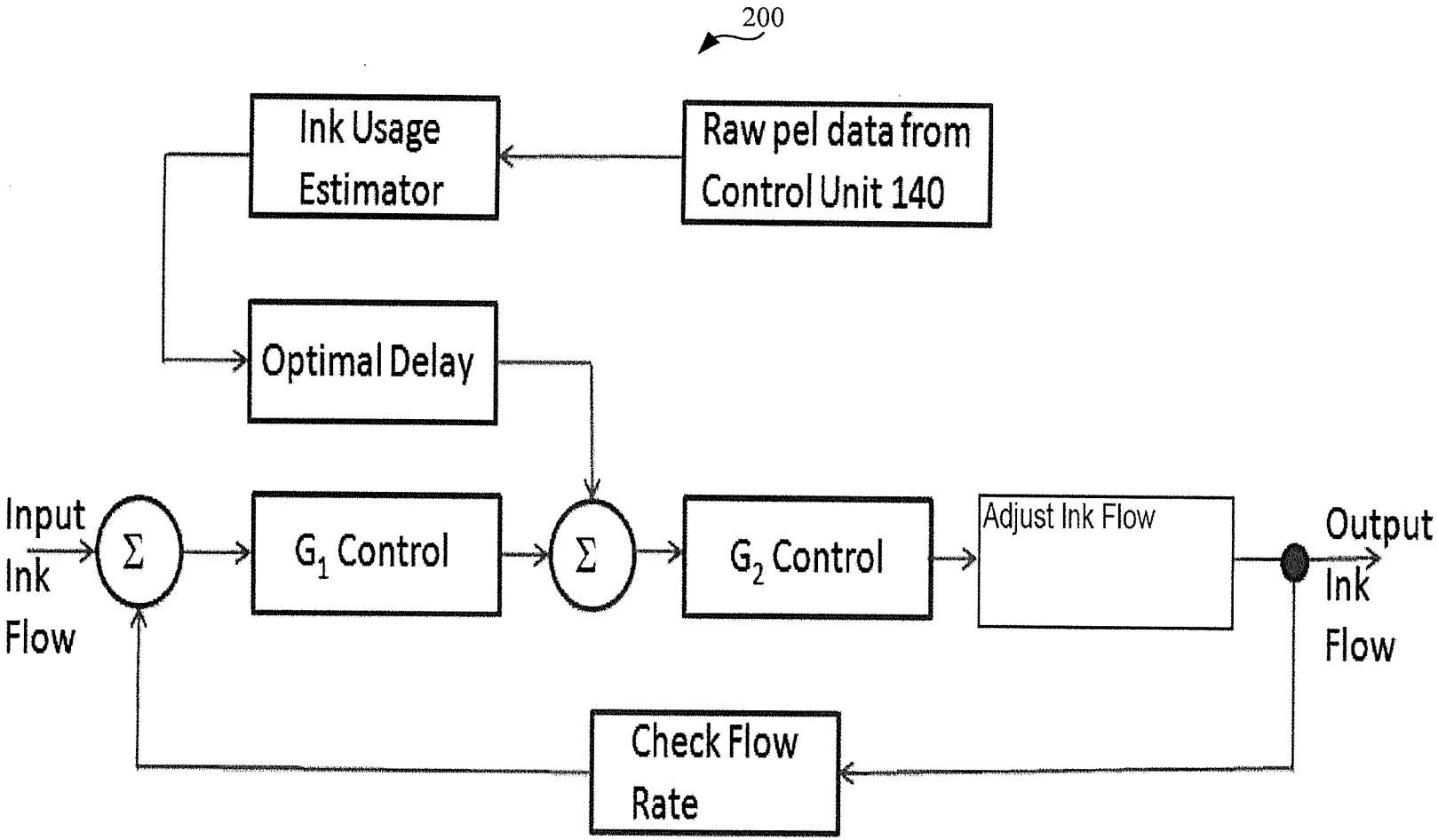
FIG. 2 illustrates one embodiment of a control system implemented by a control unit.

FIG. 2 illustrates one embodiment of a control system 200 implemented by control unit 140. As shown in FIG. 2, the control system includes a feedback system based on a measured flow rate, and a feed forward system based on the ink usage estimation and optimal timing. The flow rate from cartridge 170 is adjusted accordingly based on each system.

Figure 3:
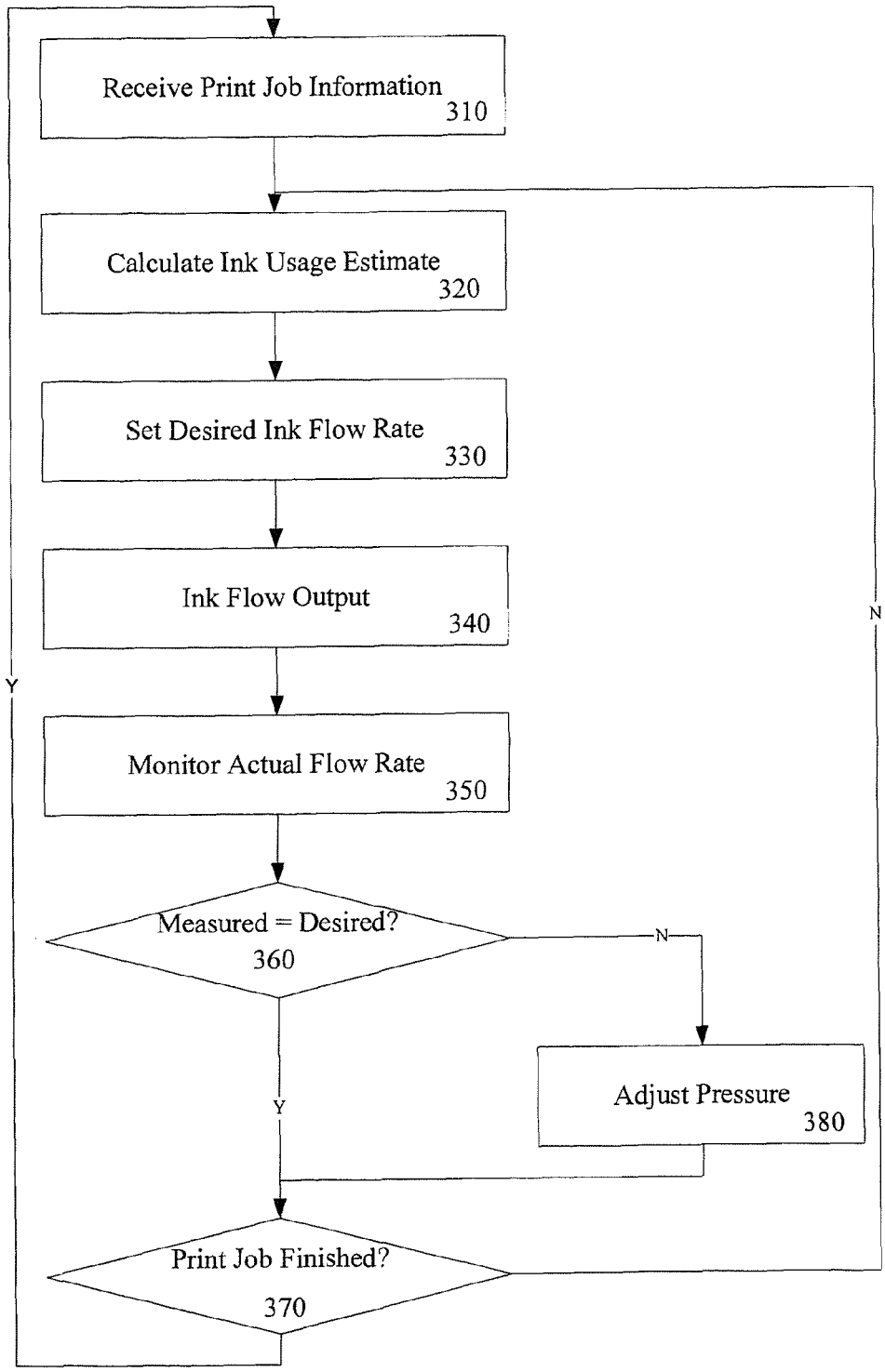
FIG. 3 is a flow diagram illustrating one embodiment of a process for regulating ink flow.

FIG. 3 is a flow diagram for one embodiment of a process for regulating ink flow. At processing block 310, control unit 140 receives information for a new print job to be printed. At processing block 320, control unit 140 estimates a volume of ink that will be needed for each sheet side to print the print job. At processing block 330, a desired ink flow rate for each sheet side the print job is set based upon the estimated ink usage after the appropriate delay (e.g., the optimal delay previously discussed above) to approximately coincide with the printing of the actual sheet side data.

At processing block 340, an ink flow output from cartridge 170 begins at the desired rate. At processing block 350, the actual flow rate measured at flow sensor 180 is monitored. At decision block 360, it is determined whether the measured flow rate is equal to the desired flow rate. If so, it is determined whether the print job has completed, decision block 370. If the print job has not been completed, control is returned to processing block 320 where the ink usage estimate is recalculated for the remaining individual sheet sides for the print job and the process is repeated from that point.

If at decision block 360, it is determined that the measured flow rate does not equal the desired flow rate, cartridge 170 output flow rate is adjusted accordingly. For instance, in one embodiment, if the measured flow rate is less than the desired flow rate, the pressure is increased. Conversely, in the same embodiment, if the measured flow rate is greater than the desired flow rate, the pressure is reduced. Subsequently, it is determined at decision block 370 whether the print job has completed. If the print job has completed, control is returned to processing block 310 for a subsequent print job.

Although described with an embodiment implementing variable ink flow rate and variable pressure based on reservoir fill time, other embodiments may implement a constant ink flow rate with constant pressure and a variable reservoir volume. The above-described mechanism therefore controls ink flow to an ink jet reservoir to ensure that the reservoir is adequately filled to supply the estimated ink demand.

Embodiments of the invention may include various steps as set forth above. The steps may be embodied in machine-executable instructions. The instructions can be used to cause a general-purpose or special-purpose processor to perform certain steps. Alternatively, these steps may be performed by specific hardware components that contain hardwired logic for performing the steps, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Throughout the foregoing description, for the purposes of explanation, numerous specific details were set forth in order to provide a thorough understanding of the invention. It will be apparent, however, to one skilled in the art that the invention may be practiced without some of these specific details. Accordingly, the scope and spirit of the invention should be judged in terms of the claims which follow.

What is claimed:

1. A method comprising:

setting a desired flow rate of ink from a cartridge to print heads in an ink jet printer;

measuring an actual flow rate of the ink;

comparing the measured flow rate to the desired flow rate; and adjusting the flow rate if the measured flow rate is not equal to the desired flow rate.

2. The method of claim 1, wherein adjusting the flow rate comprises adjusting pressure of an ink supply system in the ink jet printer.

3. The method of claim 2, wherein pressure is increased if the measured flow rate is less than the desired flow rate.

4. The method of claim 2, wherein pressure is decreased if the measured flow rate is greater than the desired flow rate.

5. The method of claim 1, wherein adjusting the flow rate comprises adjusting flow of an ink supply system in the ink jet printer using a fixed pressure, variable displacement fluid pumping device.

6. The method of claim 5, wherein flow is increased if the measured flow rate is less than the desired flow rate.

7. The method of claim 5, wherein flow is decreased if the measured flow rate is greater than the desired flow rate.

8. The method of claim 1, further comprising estimating a volume of ink to be used prior to setting the desired flow rate.

9. The method of claim 8, further comprising:

receiving information for a print job; and analyzing the print job to estimate the volume of ink for each sheet side to be used for the print job.

10. The method of claim 9, further comprising providing a delay to simulate a real time ink use estimate, wherein the ink volume adjustment for each sheet side of the print job is applied at approximately the time the data is written by a print head.

11. The method of claim 1, further comprising determining if the print job has been completed if the measured flow rate is equal to the desired flow rate.

12. A printer comprising:

a print engine including:

an ink jet print head having a plurality of ink nozzles; and a cartridge to supply ink to the print head; and a control unit to compare a measured flow rate to a desired flow rate to regulate ink flow from the cartridge to the print head, and to adjust the flow rate if the measured flow rate is not equal to the desired flow rate.

13. The printer of claim 12, wherein the print engine further comprises a flow sensing device to calculate or measure the ink flow from the cartridge.

14. The printer of claim 13, wherein the control unit regulates the ink flow based on calculations or measurements provided by the flow sensing device.

15. The printer of claim 14, wherein the control unit regulates the ink flow by adjusting pressure.

16. The printer of claim 14, wherein the control unit regulates the ink flow using a fixed pressure, variable displacement fluid pumping device.

17. The printer of claim 12, wherein the control unit estimates a volume of ink to be used for each sheet in a print job received at the printer.

18. The printer of claim 17, wherein the control unit sets a desired flow rate based on the estimate.

19. An article of manufacture comprising a machine-readable medium including data that, when accessed by a machine, cause the machine to perform operations comprising:

setting a desired flow rate of ink from a cartridge to print heads in an ink jet printer;

measuring an actual flow rate of the ink;

comparing the measured flow rate to the desired flow rate; and adjusting the flow rate if the measured flow rate is not equal to the desired flow rate.

20. The article of manufacture of claim 19, wherein adjusting the flow rate comprises adjusting pressure at an ink cartridge in the ink jet printer.

* * * * *